US005211404A

United States Patent [19]

Grant

[11] Patent Number: 5,211,404

[45] Date of Patent: May 18, 1993

[54] TARGET MOUNTING SYSTEM

[76] Inventor: Robert P. Grant, 245 McGeorge Street, Angus, Ontario, Canada, L0M 1B0

[21] Appl. No.: 837,949

[22] Filed: Feb. 20, 1992

[30] Foreign Application Priority Data

Feb. 7, 1992 [CA] Canada ..... 2060810

[51] Int. Cl.[5] ..... F41J 1/00

[52] U.S. Cl. ..... 273/407; 273/DIG. 12

[58] Field of Search ..... 273/406, 407, 408, 409, 273/DIG. 12

[56] References Cited

U.S. PATENT DOCUMENTS 3,034,788 5/1962 Cauble ..... 273/408
3,244,419 4/1966 Lerman ..... 273/409 X
3,542,365 11/1970 Gantz ..... 273/407
3,682,478 8/1972 Knight ..... 273/408

*Primary Examiner*—William H. Grieb
*Attorney, Agent, or Firm*—Anthony Asquith & Co.

[57] ABSTRACT

The system is for use on outdoor firing ranges. Target cards bearing the printed targets are secured to a 4 ft. square panel made of Coroplast (trademark), which is extruded twin-walled polypropylene sheet. The sheet is formed with built-in curvature, which is sufficient to render the target panel rigid, even though the material is thin enough that bullets can pass through without punching-out. Because of the curvature, no frame is required to keep the panel rigid. Scoring rings are printed on the face of the panel, together with a centering device which comprises markings that allow an attendant to align fresh target cards with the scoring rings. Two or three plies of Coroplast may be welded/-glued face to face, for larger targets.

13 Claims, 6 Drawing Sheets

TARGET MOUNTING SYSTEM

This invention relates to the mounting of targets on firing ranges, mainly outdoor firing ranges.

BACKGROUND TO THE INVENTION

On a typical outdoor firing range, it is customary for the targets to be mounted on a target mounting panel. Target mounting panels have typical standard sizes of 4 ft square, and 6 ft, 8 ft, and 10 ft square.

The target itself is printed on a sheet of paper or thin card. This target card may have printed on it a single bulls-eye, multiple bulls-eyes, a simulation of a human figure, or other things. Generally, the target card is smaller than the target mounting panel, so that more than one target card may be carried, side-by-side (or above or below), on the panel at the same time.

Conventionally, the target mounting panel has been made by stretching a piece of fabric, such as cotton, over a wooden frame. The wooden frame defines the outline of the square, and the fabric is tacked or stapled to the frame. A sheet of plain background paper is pasted over the whole area of the cotton fabric.

The target cards are pasted in turn over the background paper. Scoring rings are inked onto the background paper as required, the marking operation being carried out by hand, with the aid of compasses. The scoring rings, in places, pass also over the target cards.

Target cards and target mounting panels are consumable items. When a number of shots (say twenty) have been fired at a target card, the target is brought down and scoring is adjudicated, and then the bullet holes are covered with patches, made of adhesive-backed paper.

The second shooter puts twenty more bullets through the patched target. Again, the target is brought down for scoring, patched, and put up again for the next shooter. This process is repeated until the target and scoring ring markings are obliterated with patches.

Now, the target panel is removed from the target zone, and is taken to a workshop for re-covering. The old target cards and patches are removed, and the background paper is removed, to whatever extent that is possible, and then fresh background paper, and a fresh target card, are pasted onto the cotton. The panel is set aside in a dry, heated building overnight for the paste to set and dry out.

The cotton fabric panel is generally able to survive several such recoverings, perhaps four or five, at which time it becomes impractical to paste any more targets over the targets and patches already there. Often, the cotton material is still at this point serviceable, in the sense that the material is not shot away: but the target panel has to be discarded anyway, because it is so inconvenient to stick further target cards onto it.

The cotton is stretched tautly over the frame, and if the cotton or the frame should be damaged it is almost impossible to restore the tautness, with the result that the damaged panel cannot be repaired.

It is also known to make the target mounting panel from thick paperboard. (Paperboard is also called bookbinder's board, and comprises sheets of paper glued over a pressed paper core. Again the target card has to be pasted to the surface of the (fibrous) paperboard. Paperboard has the advantage over the cotton fabric panel that it is self-supporting and no frame is needed to hold the panel taut. However, paperboard is hardly less vulnerable than cotton to wet weather, and paperboard tends to be more severely damaged by the bullets passing through it than is cotton.

Paperboard is not really suitable for targets of a large area, i.e. 4 ft square and larger. Paperboard is used mainly for stick targets, i.e. targets which are mounted on a single central mounting post rather than on a frame, stick targets being generally 2 ft wide or less. For greater widths, in order to make the target rigid the paperboard would have to be thicker, which would be uneconomical.

Since the target panel is a consumable item, it is important that it be inexpensive, that it be lightweight yet robust for ease of handling, and that it can be made ready for use quickly and simply. Both the cotton panel and the paperboard panel are unsatisfactory on these counts.

It is not permitted for any portion of the target or its exposed mounting means to be made of metal (except that staples and small nails are permitted) due to the danger of ricochets.

GENERAL FEATURES OF THE INVENTION

The invention lies in providing a target panel which is made of plastic sheet material, being material of the kind which comprises opposed outer skins, held in a spaced apart relationship by interconnecting webs. Such material is widely available under the tradename Coroplast. (The invention is not, however, limited only to the use of Coroplast.)

The target card is secured to the surface of the plastic material, preferably by using adhesive patches.

In the invention, the sheet of plastic material is bowed with a degree of curvature. The curvature of the sheet is permanently built into the sheet, in that the curvature of the sheet remains present when the sheet is unsupported.

The curvature of the sheet of plastic material is shallow enough that the curvature is imperceptible to a shooter firing at the target, and is deep enough that the target panel is rigid, and remains rigid in outdoor weather conditions.

The plastic material is thin. When Coroplast is used, a 4 ft square target may be made of material that is only 3 or 4 mm thick. If the sheet were not curved, such a sheet of thin material would be too flimsy: with the curvature, a sheet of that same thickness can be rigid enough to serve as a target panel.

The target panel includes at least one, but preferably two, mounting posts. These posts are attached to the sheet, protrude downwards from below a bottom edge of the sheet, and are arranged for operative engagement into a target panel receptacle. The arrangement of the at least one post and the sheet of plastic material is such that when the post is operatively engaged in the receptacle, the target panel is presented face-on to the shooter.

Coroplast is plastic sheeting of the kind which comprises opposed outer skins, held in a spaced apart relationship by interconnecting webs. The material is an extrusion, and the webs and skins are unitary and integral with the extrusion. Coroplast may be described as twinwall polypropylene copolymer sheet. Sheets with this extruded form are often termed "corrugated", because of a similarity in appearance, and common usage as a packaging material, with corrugated cardboard.

Preferably, the curvature of the sheet is uni-axial, and the axis of the curvature is vertical. However, it is an option for the curvature to be compound.

As to the preferred radius of curvature, in the case of a nominal 4 ft square target panel, the dimensions of the sheet are such, and the curvature of the sheet is such, that the sheet forms an arc of arcuate length 49 inches and a chordal length of 48 inches. This is equivalent to a radius of curvature of about 70 inches, for the 4 ft square target.

Preferably, the material of the plastic sheet is material in which the curvature has been permanently applied by holding the sheet upon a curved mould, and applying heat thereto at a high enough temperature and for a sufficient time for the curve to become locked into the memory of the material. Preferably, the sheet is self-supporting, in that the support posts need not be, in substance, attached to each other, nor to anything, at least above the bottom edge of the sheet, other than to the sheet of plastic material; and wherein the sheet is not, in substance, attached to anything but the posts. (It should not be construed as a limitation of the invention that there be no cross-braces or the like between the mounting posts; but rather that such cross-braces are not essential.)

Preferably, the posts themselves are of Coroplast, which is folded and bent to a triangular profile, and the triangular profile is such that respective faces of the two posts lie in the same plane.

In the invention, it is not just a matter of substituting plastic in place of cotton or paperboard. The use of the curved plastic sheet provides that the whole operational procedure associated with the preparation of targets on military and other firing ranges may be improved; much of the bothersome nature of the hitherto conventional practices in target preparation have been due to the use of materials such as cotton and paperboard that are inherently unsuitable for outdoor use.

The curved plastic target panel of the invention can be light in weight, robust, rigid, and extremely simple to use. Its improvement over the conventional target panels is so marked that a marked change in operational procedures can be expected to result from its use, as can a reduction in the number of range personnel required. A particular difference is that the construction of the panels is done in-factory rather than in a workshop at the range. The curved plastic target panel has much less vulnerability to weather which means that the panel can be left out in all weathers.

DESCRIPTION OF PREFERRED EMBODIMENTS

The invention will now be further explained by describing specific embodiments of the invention. In the accompanying drawings.

It may be noted that the apparatuses shown in the accompanying drawings, and described below are examples of structures which embody the invention. The scope of the invention is defined by the accompanying claims, and is not necessarily limited by the specific features of exemplary embodiments.

Figure 1:
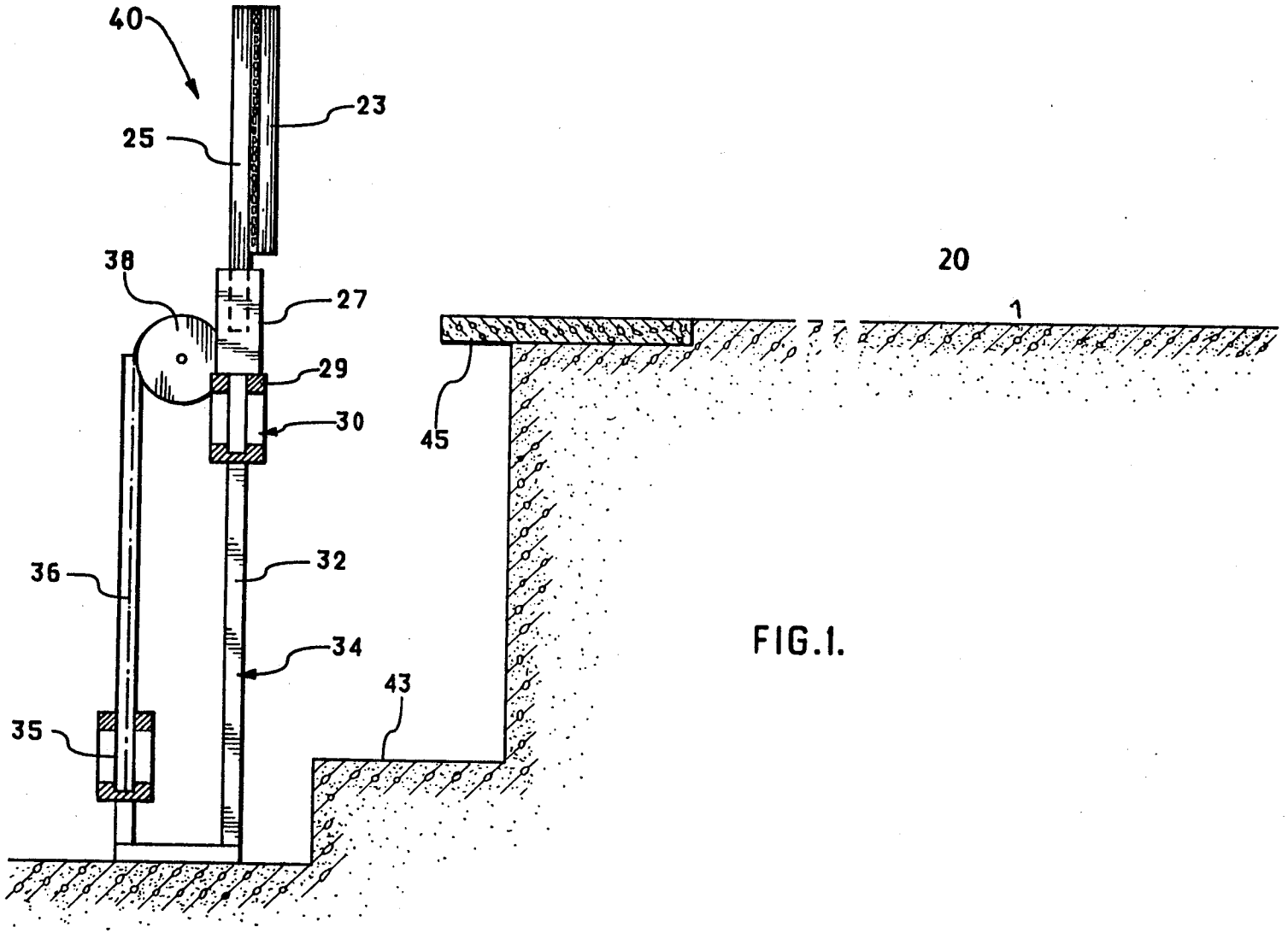
FIG. 1 is a side elevation of a firing range, in which is installed a target panel which incorporates the invention.

FIG. 1 shows a typical outdoor firing range. The shooter takes up position on the firing point 20, and shoots towards a target panel 23.

The panel 23 is attached to left and right posts 25. The posts 25 are adapted to enter complementary sockets in left and right boxes 27, as shown by dashed lines in FIG. 1.

The left and right boxes 27 are secured between the rails 29 of a trolley 30. The trolley 30 is mounted and arranged for up/down movement, guided upon an upright 32 which is a component of a fixed frame 34. Another trolley 35 is mounted on a similar upright, arranged alongside. A chain 36 is arranged between the two trolleys, and the chain passes over a pulley 38, which is mounted on the fixed frame 34.

The target zone 40 includes a platform 43, upon which the target attendant may stand during firing, and whereon he is protected by a shelter 45. When the target panel in trolley 30 is "up", as shown, the attendants can be changing targets, confirming scoring, etc, in respect of a target panel mounted in the other trolley 35. Only the "up" target panel 23, with the posts 25, protrude above ground-level.

Behind the target zone 40, i.e. to the left in FIG. 1, are sandbanks or the like (not shown) in which the bullets are absorbed, having passed through the targets.

In the typical range, several firing points are arranged side-by-side, each with a respective target panel.

The target panel 23 includes a sheet 47 of Coroplast plastic material, which will be described in detail below.

The target itself is printed or otherwise marked on a piece of paper or card, termed a target card 49. The printed target card 49 is secured flat-on to the target panel 23. The target may consist of a bulls-eye, or a number of bulls-eyes, or it may consist of a figure, of which there are several standard representations.

The target cards 49 are smaller in area than the whole area of the panel 23. The panel 23 as shown is typically 4 ft (1.22 m) square. Two or more target cards 49 may be mounted on the target panel 23 at the same time, for the shooter to shoot at in progression.

In a typical program, the shooter fires perhaps twenty bullets at each target. The target panel is then lowered by the attendant, for adjudicating and scoring etc. The attendant places patches, consisting of pieces of paper with an adhesive backing, over the twenty bullet holes, and then raises the target panel again. Depending on the type of shooting the target may be shot at and patched in this manner approximately three to five times. After that, the target would have become obliterated by the patches.

The attendant may then take off the old target card, and replace it with a fresh target card. Often, replacement of the target card would be arranged to coincide with a change of shooter at the firing point. Alternatively, it may be required to have a shooter shoot at a different type or size of target in that same session.

The manner of removing and replacing the target cards on the Coroplast panel is simple. The target cards 49 are secured to the plastic target panel by means of adhesive tape or tags: in fact the said sticky patches are ideal for attaching the target cards to the face of the target panel. It may be noted that a target card that hs been mounted to the panel by means of sticky patches can be removed from the panel much more quickly and easily than a card that has been pasted on over its whole face.

In the previous target systems, the only option was to apply paste to the whole area of the target card. The target would soon come adrift if any significant areas were left unpasted. If the small sticky patches were used as the means for sticking the target cards to a cotton or paperboard panel, or to the background paper, the small patches would not adhere to those materials with anything like the strength needed. When the panel was cotton or paperboard, because the adhesion per unit area was so low, the target card had to be pasted to the panel over its whole area.

In the new system as described, however, full-area pasting is not required. In the system as described, the small patches stick so firmly to the surface of the Coroplast sheet 47 that only a few patches placed around the edges of the target card 49 are all that is required to keep the target card firmly in place. Therefore, when the attendant comes to change targets, it is a simple matter for him to tear off the used target: this task may be contrasted with the task of trying to remove a target card that has been pasted over its full area to a piece of background paper, which itself is pasted to cotton fabric or paperboard.

Of course, some scraps of the sticky patches can be expected to remain still adhering to the Coroplast surface after the target card has been torn off, but these scraps can in fact be easily removed: insecticide sprays, for example, contain chemicals which readily dissolve the glue used on sticky patches. After removing the scraps, the surface of the Coroplast can be washed (with water) and wiped clean and dry.

All of this can be done in just a few moments, leaving the Coroplast surface ready to accept the fresh target card. The fresh card is stuck onto the panel by using the sticky patches as described.

Applying a fresh target card to the panel was not done in this manner (that is to say, by the attendant, out at the target zone) when the target cards were pasted to the background paper, and to the cotton or paperboard panel. The old target, covered with patches, simply could not generally be removed from the panel. Therefore, the fresh target card was pasted over the old target card, patches and all.

The surface onto which the fresh target card was to be pasted would be uneven because of the irregularity of the patches. Not only was it difficult to remove the target cards from the panel, it was also difficult to remove the patches from the target cards. It was not generally possible for the range attendants to prepare fresh target panels, but rather a procedure was established for collecting up the used target panels, and for taking them away to a (heated) workshop for repair and service.

Conventional target panels thus have had to be transported, by truck, to and from a heated workshop, before and after every shooting session. The panels were hardly robust enough to stand up to this treatment for any length of time.

It was sometimes possible to remove the patches from an old target card, especially on rainy days. In fact, on rainy days, often the patches could not be made to stick very well to an already well-patched target card, so that when a patched target came "down" for adjudication it was not unusual to find that there were more bullet holes than shots fired, where the patches had fallen off.

With the system as described herein, there is no need ever to stick a fresh target card over the used target card; this is because an old target card can easily be completely removed from the surface of the Coroplast panel before a new target card is applied. Therefore, with the system as described, when the attendant comes to stick patches on the target card, at least the surface of the card is flat. It has been found that, in rainy weather, patches stick to target cards much more firmly when the target card is backed by a hard, flat plastic surface, than when the target card is backed by the unevenly heaped or layered patches of target cards underneath.

Figure 3:
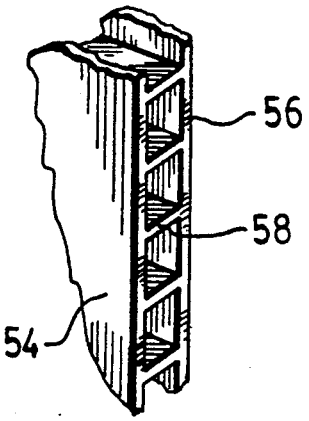
FIG. 3 is a close-up view of one of the components of the target panel of FIG. 1.

The material of the sheet 47 is shown in close up in FIG. 3. The material is of extruded manufacture, having a uniform cross-section throughout. The structure comprises surface skins 54,56 which are joined together by means of webs 58. The webs are so spaced apart that the open spaces between the webs are square in shape. Such plastic material is in wide use, and is available under the trademark Coroplast. It is used for outdoor sign panels, packaging boxes, and for many other uses.

The sheet 47 is curved. As may be understood from FIG. 2, the webs 58 of the Coroplast material lie horizontally, and the orientation of the curvature of the sheet 47 is about a vertical axis, whereby the webs themselves follow the curvature.

As mentioned, for a 4 ft square target panel, the horizontal dimension of the sheet is cut to an actual width of 49 inches, rather than 48 inches. The sheet is bowed sufficiently that the sheet as presented to the shooter appears to be 48 inches wide. This amount of curvature, it has been found, is well capable of keeping the target panel rigid even in the kind of violently windy conditions in which cotton target panels would be likely to be damaged and torn. This amount of curvature, on the other hand, is quite imperceptible to the shooter at the firing point, and makes no difference to the scoring and adjudicating procedures.

For the targets of larger area, the amount of curvature is correspondingly increased.

The curvature is built into in the Coroplast sheet permanently, by moulding the sheet to the curved shape. The curved sheet 47 starts off, as extruded, as a flat sheet. This flat sheet is placed over a curved mould, which is made to the desired curvature. The flat sheet is pressed, counter to its own natural resilience, onto the curved mould, and held there. The material is heated to 275 deg F. After the temperature of the plastic material has stabilised, which takes a few minutes, the temperature of the sheet is quickly brought down to 40 deg F. or so. This treatment locks in the curvature of the mould into the sheet.

It has been found that the "memory" of the moulded-in curvature is virtually complete: even if the material is stored in a strained condition, for example if many sheets are stacked upon each other, the sheet quickly regains the curvature as its natural shape. Similarly, if the sheet is exposed to the heat of the summer sun, or indeed to any adverse weather conditions, the sheet does not tend to become more bowed, not to flatten out.

Because of this memory, the curved plastic sheet can be expected to be highly resistant to damage. The sheets may be stacked and handled, placed on and off trucks, occasionally stepped on, and generally abused, without much need for care. This may be contrasted with the amount care that was required when dealing with the conventional target panels.

This is not to say that the Coroplast target panel is indestructible: the point is that a target panel made from bowed Coroplast sheet is very much more robust and efficient than a panel made from the known materials.

Again, it may be noted that the curvature is built into the Coroplast sheet 47 during the manufacture of the sheet 47. There is no need for range personnel to be involved with setting the degree of curvature. The range staff are not called upon, for instance, to do such things as apply a special tightening force to a strut or frame so as to induce a desired amount of bow to the panel.

The left and right posts 25 on which the Coroplast sheet is mounted (FIG. 2) are of wood. The sheet 47 may be attached by means of nails, or by means of plastic fasteners. (Metal fasteners, apart from nails, cannot be used—by regulation in most jurisdictions—because of the danger of ricochets.) As shown in FIG. 2A, because of the curvature of the sheet, the (rectangular) posts 25, and the boxes 27, lie at an angled orientation with respect to the trolley rails 29. Wedges 59 are provided, and used to constrain the boxes 27 between the rails 29.

Again, it should be noted that the curvature of the sheet 47 is not induced by setting the boxes at a particular angle: rather, it is the sheet which is already curved, whereby the posts and boxes fall consequently to the particular angle.

Figure 4A:
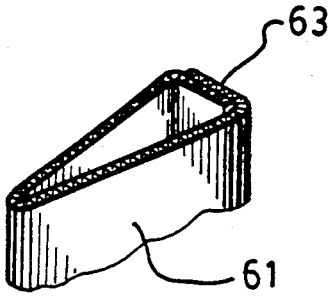
FIG. 4A is a close-up view of one of the components of the target panel of FIG. 4.
Figure 4:
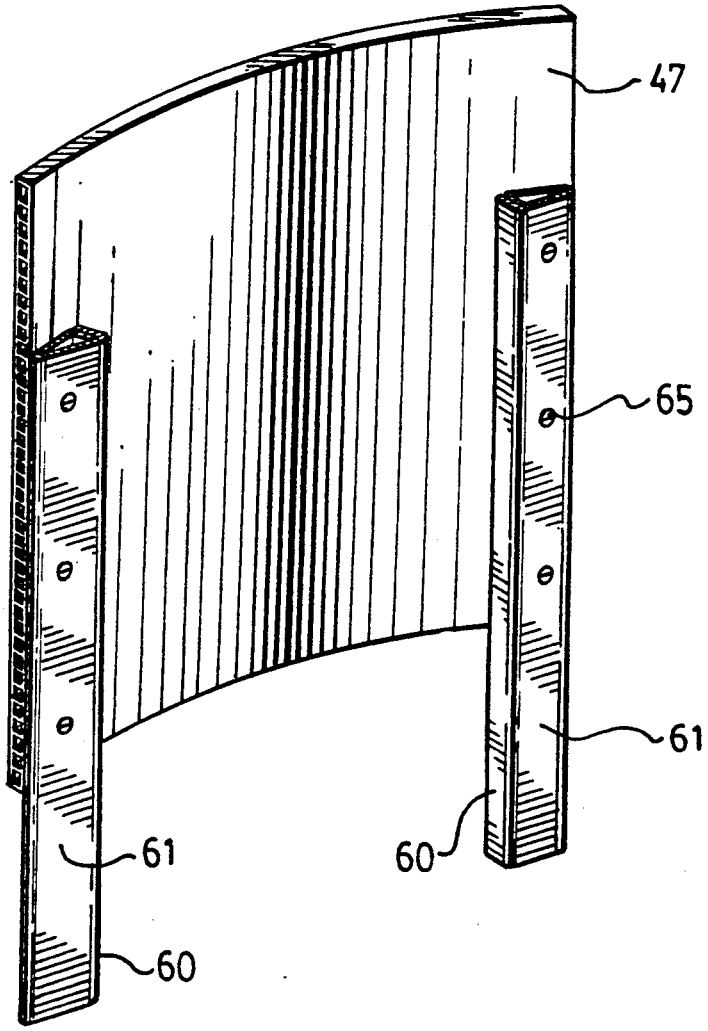
FIG. 4 is a pictorial view of one of the components of a modified target panel.

In an alternative construction, as shown in FIG. 4, the panel posts 60 may be of triangular shape. The posts 60 are themselves formed from sheet Coroplast, which is bent and folded to the triangular shape. The angle of the triangle is such that with the curvature of the panel sheet 47, the faces 61 of the posts 60 lie both in the same plane. The posts are dimensioned to fit directly in the boxes 27.

The folded Coroplast of the post is provided with tabs or flaps 63 which may be glued or welded, as shown, to make the triangle.

The posts 60 are attached to the sheet 47 by means of plastic nuts and bolts 65, or other plastic fasteners. It is convenient for the posts 60 to be 4 ft long, so that they may be cut from standard-sized extruded sheeting, so, since the posts are to enter approximately 1 ft into the boxes 27, it is convenient for the post to terminate 1 ft from the top of the panel sheet. The fact that the top portion of the curved sheet 47 is therefore not stiffened by the post 60 may be ignored, since the sheet is more than adequately rigid, due to its curvature.

It can happen that a poorly aimed series of shots can cut through one of the target panel support posts. In the cotton fabric target panels, if the post was damaged, the whole target panel had to be discarded—the cotton was stretched taut over the frame, and it was not possible to recapture the tautness upon replacing the post. When the target panel comprises the curved sheet of Coroplast, on the other hand, the posts, whether made of wood or of folded Coroplast, can be removed quite simply from the sheet, and replaced as separate components. With the Coroplast panel, the post is not required to interact with the sheet in any way, other than for simple support. In particular, the curvature of the sheet is set during the manufacture of the sheet; the curvature of the sheet is not induced by the orientation of the posts.

It is not essential that the boxes 27 be used. The benefit of using the boxes is that the support legs or posts 25 need not extend all the way down into the trolley, and so, if a leg should be shot up, only the short leg need be replaced. The boxes should be dimensioned so that the top of the box lies just below the path of the bullets. The boxes are hollow inside, and the post 25 is received inside the hollow. The length of the post and the depth of the hollow are set so as to provide the correct height of the target panel in relation to ground level: it is convenient to manufacture all target legs of the same length, and to tailor the depth of the hollow in the box respective to the dimensions of the particular target point.

Particularly in the smaller sizes of target, sometimes a target panel is provided with only one leg, in which case the target is termed a stick-target. A major benefit of the invention is that it permits the target panels to be large, and yet sufficiently rigid; with the smaller panels the rigidity problem does not arise, but still the bowed panel of the invention may be used for stick-targets.

The Coroplast material of the sheet 47 should be of the correct thickness. It has been found that a thickness of 3 or 4 mm overall is advantageous. It has been found that thicker Coroplast, 6 mm thick for example, has the disadvantage that bullets passing through it tend to punch out small packets of plastic material. This is not important from a structural point of view, but the problem that arises is one of litter.

Both cotton panels and paperboard panels did not pose a litter problem. When bullets pass through these materials, they tear and split the material, of course, but it is unusual for (small) portions of the material actually to be torn away. Therefore, the area of ground behind the targets has not traditionally been beset by litter comprising pieces of debris torn from the panels. The range personnel therefore have not hitherto had to cope with a litter problem.

If, however, 6 mm Coroplast is used for the panel sheet, it cannot be ruled out that myriads of small punched-out packets of plastic material would soon start to accumulate on the ground behind the targets, and these would be very difficult to sweep up. This problem is serious, because a target panel that produced unsweepable litter would find little acceptability among range personnel.

Bullets passing through 4 mm and thinner Coroplast do not tend to punch out packets of plastic, but tend rather to leave the plastic simply with a hole in it, and not detached. Thus, 4 mm Coroplast is no worse than the previous forms of target panel, from the point of view of litter.

Especially for the larger targets, however, rigidity is a concern, and of course, the thicker the Coroplast, the more rigid the curved sheet, and the more rigid and robust the panel. The 3 or 4 mm thickness gives adequate rigidity in the 4 ft square panel, but may be regarded as a little flimsy in the larger 6 ft, 8 ft, and 10 ft sizes.

Figure 5:
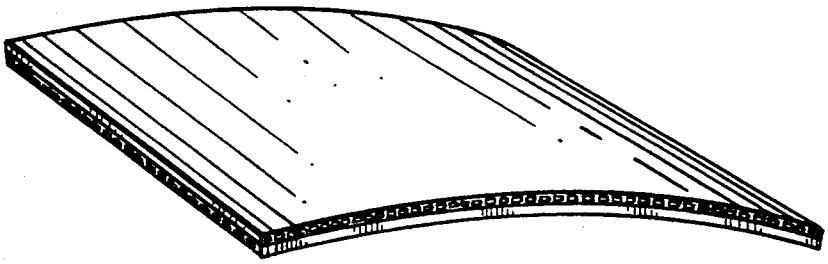
FIG. 5 is a pictorial view showing one of the components of a modified target panel.

FIG. 5 shows how this compromise as to the thickness of the Coroplast may be addressed. Here, two thin sheets of Coroplast are glued or welded together, face-to-face, to form a thick composite sheet. It has been found that bullets passing through two thin sheets of Coroplast glued or welded together do not punch out packets of plastic debris, whereas bullets passing through a single sheet of double the thickness do produce litter. Also, it has been found, especially when the webs in the two Coroplast sheets are oriented at 90 deg to each other, the composite panel is substantially more rigid than a single sheet of corresponding thickness.

It has been found that placing a thin sheet of Coroplast behind a thicker sheet, for example a 3 mm sheet behind a 6 mm sheet, has the effect of preventing punch-out, which would be expected from the 6 mm sheet on its own.

The sheets also may be glued or welded in three, or more, plies.

Figure 6:
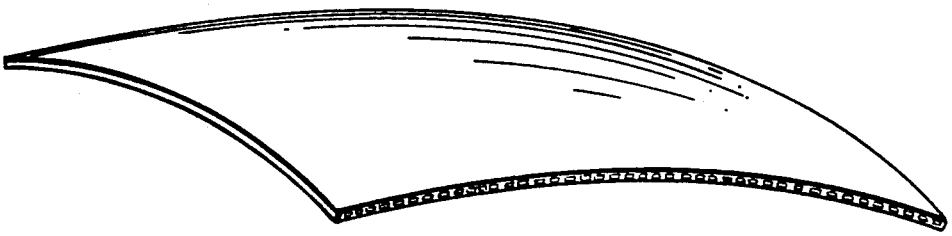
FIGS. 6 and 7 are pictorial views showing components of other modified target panels.

The panels shown in FIGS. 1-5 have had a simple uni-axial curvature, as described. FIG. 6 shows a sheet of Coroplast that has been bent to a compound curvature. The compound curve gives a good improvement in rigidity, though the compound-curved mould onto which the sheet is clamped for moulding is rather more expensive to provide than a simple-curved mould. The compound curved arrangement lends itself particularly to the double-sheet construction, because the individual sheets, being thin, are relatively easy to bend to the compound-curved mould.

Figure 7:
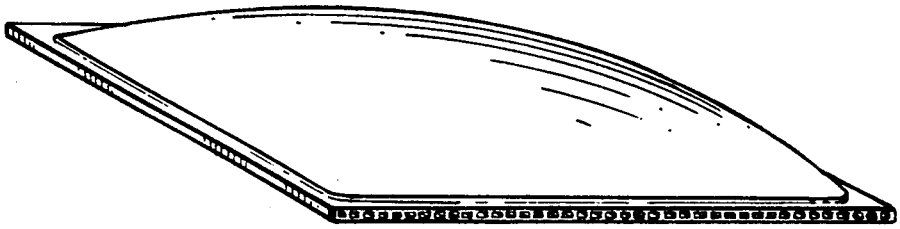

With the compound curved sheet, there can be some difficulty over attaching the posts to the sheets, as may be inferred from FIG. 6. This latter difficulty is overcome when the sheet is moulded to the shape as shown in FIG. 7. Here, a centre portion of the sheet is curved into a shallow dome, and a margin surrounding the dome is left flat. The posts can be attached to the flat margins. Again, the mould required to produce this shape is rather more expensive.

The curved Coroplast target panel, as described, can be expected to remain serviceable for a much longer period than previous target panels. The panel as described poses few difficulties of storage, nor of assembly and repair, and also can be expected to remain serviceable in all weathers in which target shooting takes place. The conventional cotton panel, for example, was unserviceable after three, four, or perhaps five target cards had been pasted over the panel. Thus, the cotton panel was spent after taking two hundred or perhaps three hundred bullets.

The curved Coroplast target panel may be used more than that. Even after taking many hundreds of bullets, the front face of the panel can be very easily prepared for yet another fresh target card to be applied, and the tenth new card will be secured just as firmly as the first. Naturally, the target panel will eventually become unserviceable due to the concentration of bullet holes therein, but the nature of the bowed or curved Coroplast target panel is such that the target panel will remain serviceable right up until significant areas of the material is actually shot away.

A number of factors may be described in relation to this long life. The conventional cotton target panels had to be brought indoors after a day's shooting—to dry out, and for needed repairs. But the cotton target panels were unlikely to last much more than one day's session in any event. It is desirable, in the case of a target panel that will last for much longer than one session, that the panel be made of such material that the panel can be left outside indefinitely, in all weathers; and that is true of the Coroplast material.

Even if there is little call to leave the target panel that is not in-use actually out of doors, at least the Coroplast sheet can be stored in a non-heated building. There is usually a hut on the firing range itself, perhaps at the target zone. If the panels can be left in this hut, the saving is that there is no need to transport them back to the workshop.

Another factor is that, since it is so easy to change the target cards, the task of changing the target cards can be done quickly and easily by the target zone attendants. The task can even be done in some cases without removing the target panels from the trolleys.

The target zone attendants were not, with the previous target systems, required to place, or replace, target cards on the panel: that work was left to the service staff in the workshop. With the curved Coroplast panel, because replacement of the target cards now can actually be done at the target zone, by the attendants, the requirement now arises for the attendant to be provided with some simple means for aligning the target cards in the correct position on the target panels.

When the target changing was done in a workshop, as with the cotton panels, care could be taken to ensure that the fresh target cards were correctly aligned on the panels. With a cotton panel, there was no real need for alignment aids.

Also, with the conventional panels, the scoring rings were inked onto the panel after the target cards had been pasted on, and consequently the scoring ring would be automatically centred with respect to the target card. However, when the target card replacements are being done actually at the target zone, by the attendant, alignment is more difficult, and alignment aids become more of a necessity.

Figure 2:
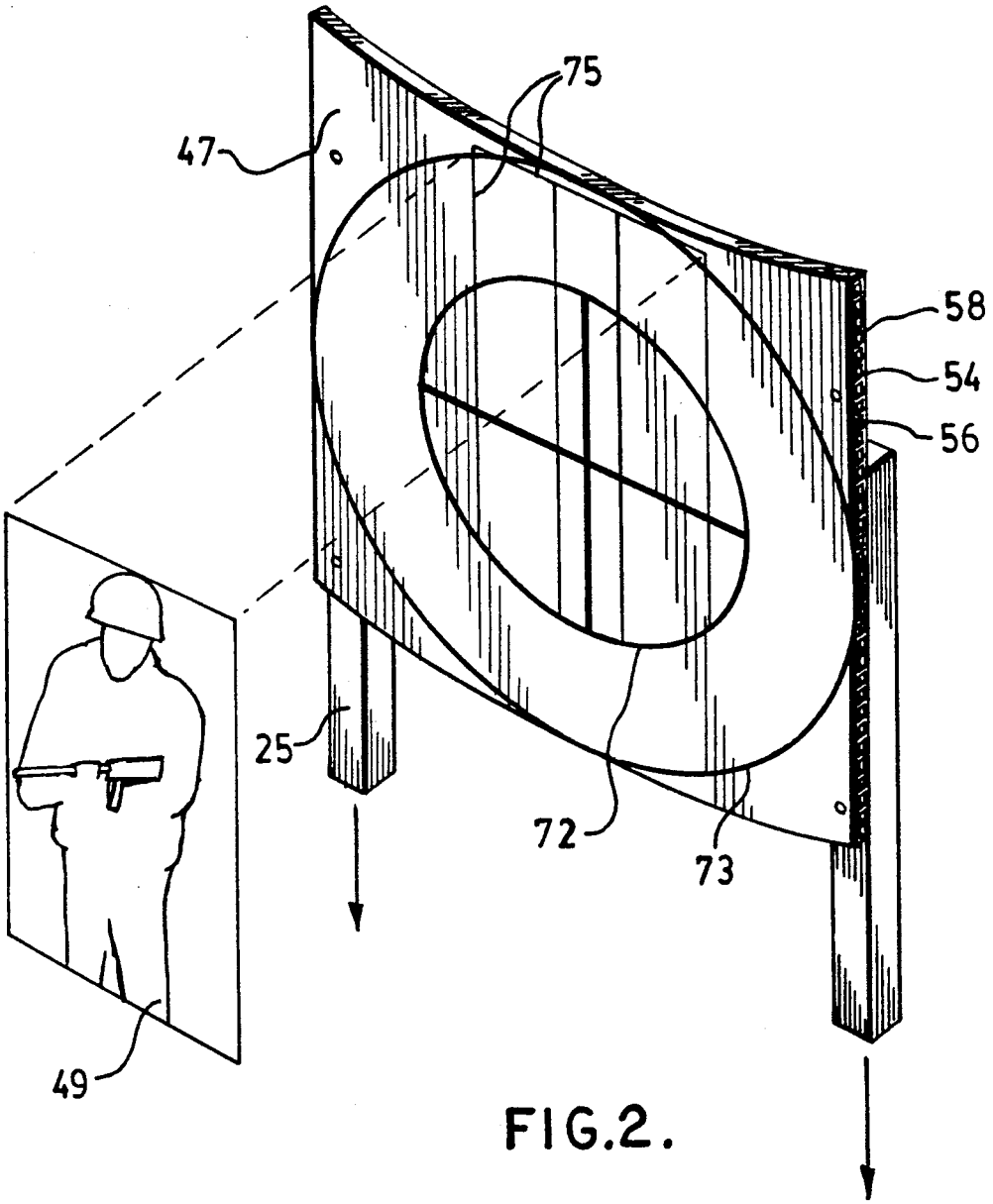
FIG. 2 is a pictorial view of the target panel of FIG. 1.
Figure 2A:
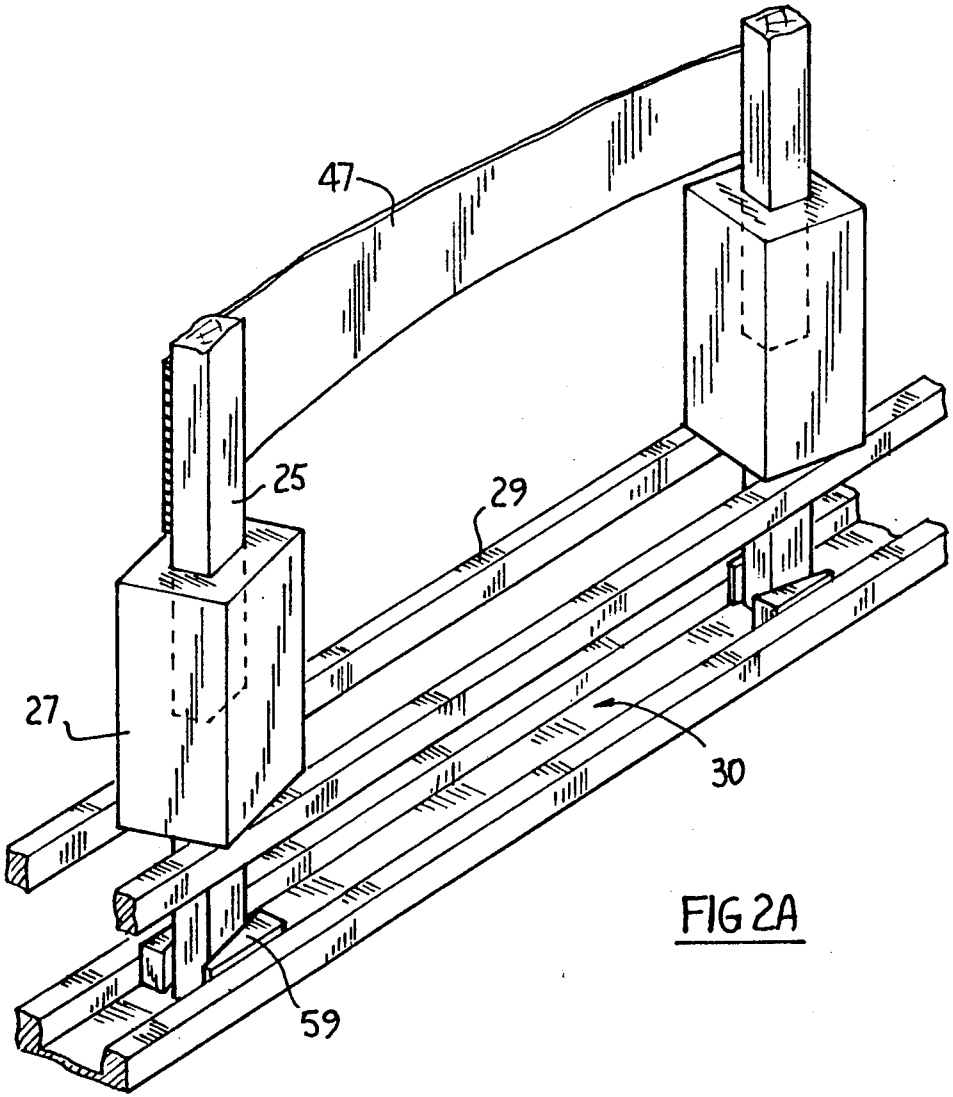
FIG. 2A is a pictorial view of some of the components of the target panel of FIG. 1, showing the manner of mounting same.
Figure 8:
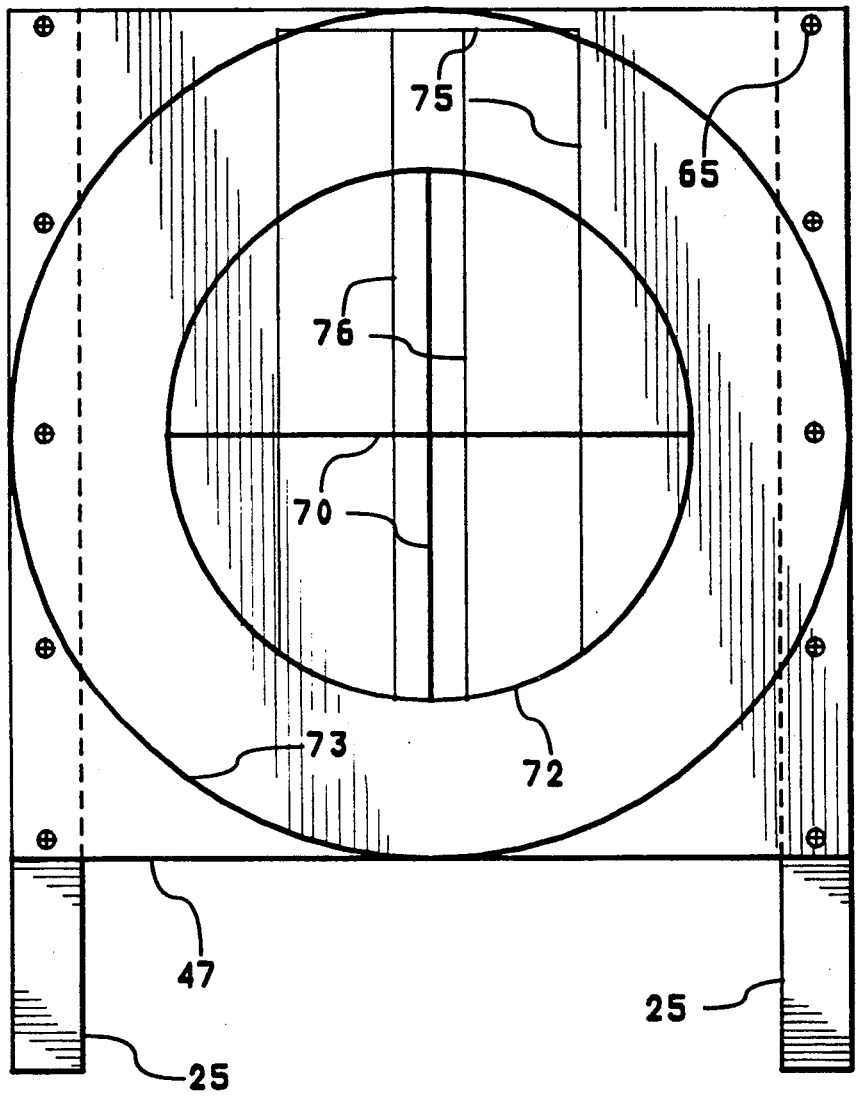
FIG. 8 is a diagram showing the layout of markings printed on the target panel of FIG. 1.

As shown in FIGS. 2 and 8, markings are placed on the face of the panel itself. In particular, the scoring rings are marked actually on the panel. Because of this, when a fresh target card is being secured to the panel, the attendant faces the difficulty of ensuring that the centre of the target corresponds to the centre of the scoring ring. This problem did not arise on the pasted panels, because then the scoring rings were put on after the target card had been pasted on.

A preferred feature of the invention is the provision of alignment markings actually printed onto the face of the Coroplast panel. The alignment markings complement the scoring rings; they make it easy for the attendant to quickly align the target card to correspond with the scoring rings.

Thus, the markings on the sheet comprise scoring rings and alignment, or centering, aid markings. In fact, it can be provided, for instance, that the scoring rings and the centering cross-lines be in red, and the target card alignment markings be in blank.

Coroplast is the kind of material that lends itself to the application of permanent markings upon the surface of the material. The lines can be printed onto the Coroplast of such ink as will resist fading for twelve months or more, even if left outdoors, in sunlight and in all the other weather conditions.

With the cotton target panels, it was not practically possible to apply permanent markings of such things as scoring rings or alignment markings on the cotton material. Such markings can be readily provided on Coroplast, however.

FIG. 8 shows the target panel of FIG. 2, face-on. The various markings will now be explained.

Usually, the intention will be that a single target card is placed in the centre of the target panel. The face of the panel is provided with cross-line markings 70, which define the centre of the panel. Scoring rings 72,73 are drawn of 2.5 ft diameter and of 4 ft diameter, as shown, about the same centre. The cross-line markings 70 make it easy for the attendant to line up the new target cards centrally, with sufficient accuracy to make the use of the scoring rings meaningful. If there were no alignment aid markings, the target cards might be an inch or even more out of position and the fact not be picked up by the attendant, which would produce a corresponding error in the shooter's score.

Sometimes, the target is of irregular shape. For example, the target may comprise a charging figure. In this case, the target is high, and narrow, but conforms to standard dimensions. The rectangular markings 75 define one of the standard charging figure target (item 49 in FIG. 2—known as an "11/59" target), which is 17.5 inches wide. The top line of the rectangle marks the top of the target. When the target is correctly placed to this line, the scoring rings may be brought into use. Within limits, it does not matter how the scoring rings are disposed in relation to the target, so long as that disposition is always the same.

The actual markings may be varied: the important aspect of the markings is that they permit the attendant to align the target card in relation to the scoring rings in an accurate, repeatable manner.

Sometimes, it is preferred to place two 11/59 targets side-by-side on the panel. Now the scoring rings are less useful, but it is still important to align and place the targets correctly on the panel. The lines 76 are used to help the attendant space the targets apart the recommended distance.

Although the curve of the plastic sheet has been shown as being outwards, in FIGS. 2 and 4, the curve can be the other way, i.e. with the bulge away from the shooter rather than towards him. The panel may therefore be printed on both sides. The markings on the reverse side may be the same, or different.

In fact, reversing the curved Coroplast panel can be done as a matter of course. It may be considered that reversing the panel would involve the attendant in a great deal of extra work, in patching the exits of the bullet holes, on the reverse face of the panel, as well as having patched the entries on the front face. However, it has been found, at least with 3 and 4 mm Coroplast, that the exits are very much smaller than the entries. Therefore, when scoring, the adjudicator does not confuse the old exits with the new entries, and it is not therefore necessary to patch the exits. (This is not true with the thicker 6 mm material, where, as mentioned, many of the exits are punched out.)

It has been noted that the standard 6 mm Coroplast material is less preferred because of the punching-out phenomenon. Small fragments of the rear skin of the 6 mm material are bodily removed by the bullet, whereas the same bullet passing through 3 mm material does not punch out a fragment, but just leaves a small hole: smaller in fact than the diameter of the bullet, in that the thinner material appears to close down somewhat after the bullet has passed through.

Conventional 6 mm twin-wall material has a wall thickness of about 0.025 inches, whereas 3 mm material has a wall thickness of about 0.012 inches. A wall thickness of about 0.020 inches should preferably not, in practice, be exceeded, in order to avoid the risk of punching out. On the other hand, the overall thickness of the panel material should preferably be large, so that the panel as a structure can be stiff and rigid. Thus, a panel material which has an overall thickness of 6 mm or more, but a skin thickness of 0.020 inches or less, is preferred for use in the invention.

Especially in the larger size target panels, the thicker material, i.e. 6 mm or more, is preferred on the grounds of stiffness and robustness. As previously mentioned, one way of providing the required thickness, which avoids the problem of punch-out, is to glue two, or even three, sheets of thin material together face to face. However, it can be quite expensive to provide and apply adhesive in sufficient quantity to glue two e.g. 6 ft square sheets of plastic together. Since it is mainly the skin or wall thickness, rather than the overall thickness, that determines whether punch-out will be a problem, again it is especially preferred to use a material which has an overall thickness of 6 mm or more, and a wall thickness of 0.020 inches or less, even though those dimensions are not standard for conventional twin-wall plastic material.

Generally, the above described benefits may be understood to arise from the fact of using plastic material, and from the fact of curving the plastic material so that the sheet of material becomes rigid enough to serve as a target panel without the need for a support frame.

Another benefit arises from curving the panel. Plastic materials like polypropylene have a comparatively high coefficient of thermal expansion; an outdoor target is exposed to the extreme range of temperatures, whereby a 4 ft target panel can be expected to undergo substantial expansions and contractions across its width. If the plastic sheet had to be stapled or nailed to a rigid frame, and the work done in a heated workshop, and then the panel were placed outside at minus 40 deg, it would be quite possible for the contraction of the sheet to be such that the material would be torn and split around the fastenings. By contrast, the curved plastic target panel as described, with no frame as such, can be made in large squares, and can be exposed to temperature extremes, with no danger at all of tearing around the fastenings. It should be noted that the polypropylene copolymer which has been described is recyclable. Thus, when the panel is rendered useless by having been shot through, the panel can be broken down and recycled. The material does not deteriorate over time, in the sense of its losing or acquiring substances that would make it unsuitable for recycling. On the other hand, the material can, if desired, also readily be made degradable, responsive to prolonged exposure to sunlight.

I claim:

1. Target panel, suitable for use on an outdoor firing range, wherein:

the target panel includes a sheet of plastic material, being material of the kind which comprises opposed outer skins, held in a spaced apart relationship by interconnecting webs;

the sheet of plastic material has a surface which is adapted to receive a target card;

the sheet of plastic material is bowed with a degree of curvature;

the curvature of the sheet is permanently built into the sheet, in that the curvature of the sheet remains present when the sheet is unsupported;

the curvature of the sheet of plastic material is shallow enough that the curvature is imperceptible to a shooter firing at the target;

the curvature of the sheet of plastic material is deep enough that the target panel is rigid, and remains rigid in outdoor weather conditions;

the target panel includes a mounting means, which is arranged for operative engagement with a complementary target panel receptacle;

and the arrangement of the mounting means and the sheet of plastic material is such that when the mounting means is operatively engaged in the receptacle, the target panel is presented face-on to the shooter.

2. Target panel of claim 1, wherein the sheet of plastic material, being material of the kind which comprises opposed outer skins, held in a spaced apart relationship by interconnecting webs, is an extrusion, and the webs and skins are unitary and integral with the extrusion.

3. Target panel of claim 2, wherein the material is Coroplast (trademark).

4. Target panel of claim 1, wherein the curvature of the sheet is uni-axial, and the axis of the said curvature is vertical.

5. Target panel of claim 4, wherein the dimensions of the sheet are such, and the curvature of the sheet is such, that the sheet forms an arc of acuate length 49 inches, and of chordal length of 48 inches.

6. Target panel of claim 1, wherein the material of the said sheet is material in which the curvature has been permanently applied by holding the sheet upon a curved mould, and applying heat thereto at a high enough temperature and for a sufficient time for the curve to become locked into the memory of the material.

7. Target panel of claim 1, wherein the sheet is rectangular, and the mounting means comprises two mounting posts, which are disposed upright at the left and right side edges of the sheet.

8. Target panel of claim 7, wherein the sheet is self-supporting, in that the two posts are not, in substance, attached to each other, nor to anything, at least above the bottom edge of the sheet, other than the sheet of plastic material; and wherein the sheet is not, in substance, attached to anything but the posts.

9. Target panel of claim 7, wherein the posts are of Coroplast, which is folded and bent to a triangular profile, and wherein the triangular profile is such that respective faces of the two posts lie in the same plane.

10. Target panel of claim 1, wherein the curvature of the sheet is compound.

11. Target panel of claim 1, wherein the panel is four feet square, or larger.

12. Target panel of claim 1, wherein the overall thickness of the sheet of plastic material is 6 mm or greater, and the thickness of at least one of the skins is 0.020 inches or less.

13. Target panel of claim 1, wherein the panel includes two of the side sheets of plastic, secured together face-to-face.

* * * * *